US009952560B2

(12) United States Patent
Suzuki

(10) Patent No.: US 9,952,560 B2
(45) Date of Patent: Apr. 24, 2018

(54) SWITCH DEVICE AND TIMEPIECE

(71) Applicant: CASIO COMPUTER CO., LTD., Shibuya-ku, Tokyo (JP)

(72) Inventor: Junichiro Suzuki, Kunitachi (JP)

(73) Assignee: CASIO COMUTER CO., LTD., Tokyo (JP)

( * ) Notice: Subject to any disclaimer, the term of this patent is extended or adjusted under 35 U.S.C. 154(b) by 0 days.

(21) Appl. No.: 15/245,639

(22) Filed: Aug. 24, 2016

(65) Prior Publication Data

US 2017/0115636 A1 Apr. 27, 2017

(30) Foreign Application Priority Data

Oct. 21, 2015 (JP) ..... 2015-207015

(51) Int. Cl.

*G04B 37/08* (2006.01)
*G04C 3/00* (2006.01)
*G04G 17/06* (2006.01)

(52) U.S. Cl.

CPC ..... *G04C 3/001* (2013.01); *G04C 3/007* (2013.01); *G04G 17/06* (2013.01); *G04B 37/08* (2013.01)

(58) Field of Classification Search

CPC ..... G04B 3/04; G04B 3/041; G04B 3/043; G04B 3/045; G04B 17/06; G04C 3/001; G04C 3/007; H01H 67/06; H01H 67/12

USPC ..... 368/319, 320, 321

See application file for complete search history.

(56) References Cited

U.S. PATENT DOCUMENTS 441,322 A * 11/1890 Morrill ..... G04B 3/04 368/307
441,435 A * 11/1890 Morrill ..... G04B 3/04 368/307
441,436 A * 11/1890 Morrill ..... G04B 3/04 368/307
5,184,334 A * 2/1993 Vollert ..... G04B 37/10 368/319
5,521,890 A * 5/1996 Miche ..... G04B 37/106 368/319
6,137,750 A * 10/2000 Rieben ..... G04B 37/103 368/290

(Continued)

FOREIGN PATENT DOCUMENTS

CH 160802 A 3/1933
JP 54097152 U 7/1979
JP 2010249716 A 11/2010

OTHER PUBLICATIONS

Taper—dictionary.com—Sep. 28, 2017.*

(Continued)

*Primary Examiner* — Sean Kayes
(74) *Attorney, Agent, or Firm* — Holtz, Holtz & Volek PC

(57) ABSTRACT

A switch device including a case which is provided with a through hole and has a built-in module, a cylindrical member which is attached to the through hole of the case and whose inner end portion protrudes inside the case and is held in the module and outer end portion protrudes outside the case, and an operation member including a shaft section which is arranged inside the cylindrical member in a manner to be slidable in an axial direction of the cylindrical member so as to operate the module and a head section which is provided on an outer end portion of the shaft section and covers and slidably holds the outer end portion of the cylindrical member.

20 Claims, 6 Drawing Sheets

(56) References Cited

U.S. PATENT DOCUMENTS

| | | | | |
|---|---|---|---|---|
| 6,200,020 | B1 * | 3/2001 | Rieben | G04B 37/10 368/290 |
| 7,360,944 | B2 * | 4/2008 | Morel | G04B 37/10 368/308 |
| 8,721,171 | B2 * | 5/2014 | Tsuji | G04B 37/0008 368/319 |
| 2007/0147186 | A1 * | 6/2007 | Morel | G04B 37/10 368/319 |
| 2014/0286146 | A1 * | 9/2014 | Sakurazawa | G04B 3/043 368/308 |

OTHER PUBLICATIONS

Translation ch 160802—espacenet—Sep. 29, 2017.*
Japanese Office Action (and English translation thereof) dated Sep. 5, 2017 issued in counterpart Japanese Application No. 2015-207015.

* cited by examiner

SWITCH DEVICE AND TIMEPIECE

CROSS-REFERENCE TO RELATED APPLICATION

This application is based upon and claims the benefit of priority from the prior Japanese Patent Application No. 2015-207015, filed Oct. 21, 2015, the entire contents of which are incorporated herein by reference.

BACKGROUND OF THE INVENTION

1. Field of the Invention

The present invention relates to a switch device that is used in an electronic device such as a wristwatch, a cellular phone, and a portable information terminal, and to a timepiece having the switch device.

2. Description of the Related Art

For example, a switch device for a wristwatch is known which has a structure in which, when a cylindrical member is to be mounted in a through hole of a wristwatch case with a built-in timepiece module, an elastic member is provided between the inner circumferential surface of the through hole of the wristwatch case and the outer circumferential surface of the cylindrical member, and an operation member for operating the timepiece module is provided inside the cylindrical member in this state, as disclosed in Japanese Patent Application Laid-Open (Kokai) Publication No. 2010-249716.

This type of switch device is structured such that, when an external impact on the wristwatch case causes positional displacement between the wristwatch case and the timepiece module, the elastic member provided between the inner circumferential surface of the through hole of the wristwatch case and the outer circumferential surface of the cylindrical member is elastically deformed to cause the displacement of the cylindrical member in the radial direction thereof, whereby a load such as shearing force imposed on the operation member is reduced in accordance with the displacement of the cylindrical member in the radial direction thereof.

However, since this switch device of the wristwatch is structured such that the cylindrical member is held with the elastic member provided between the inner circumferential surface of the through hole of the wristwatch case and the outer circumferential surface of the cylindrical member, the cylindrical member is easily displaced in the radial direction thereof and is unstable, and accordingly the strength of the cylindrical member cannot be ensured unless the cylindrical member is formed having a larger outer diameter. This leads to not only a larger outer diameter of the cylindrical member but also a larger inner diameter of the through hole of the wristwatch case, which causes an increase in the thickness of the wristwatch case.

SUMMARY OF THE INVENTION

The present invention is to provide a switch device that allows the outer diameter of a cylindrical member and the inner diameter of a through hole of a case to be smaller and the case to be thinner thereby, and to provide a timepiece including the switch device.

In accordance with one aspect of the present invention, there is provided a switch device comprising: a case which is provided with a through hole and has a built-in module; a cylindrical member which is attached to the through hole of the case, and whose inner end portion protrudes inside the case and is held in the module and outer end portion protrudes outside the case; and an operation member including a shaft section which is arranged inside the cylindrical member in a manner to be slidable in an axial direction of the cylindrical member so as to operate the module, and a head section which is provided on an outer end portion of the shaft section and covers and slidably holds the outer end portion of the cylindrical member.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment in which the present invention has been applied in a wristwatch will hereinafter be described with reference to FIG. 1 to FIG. 6.

As shown in FIG. 1 to FIG. 3B, this wristwatch includes a wristwatch case 1. This wristwatch case 1 includes a first case 2 and a second case 3, which are formed of a lightweight metal with high rigidity, such as titanium (Ti).

Figure 2:
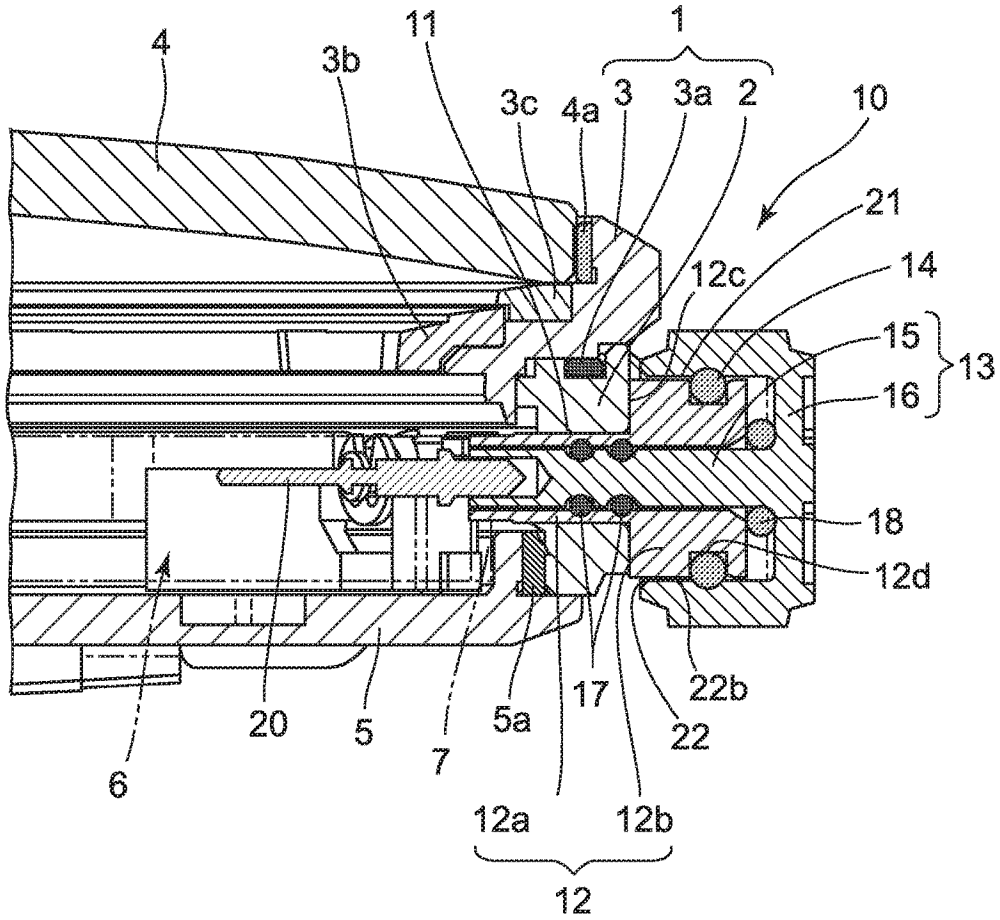
FIG. 2 is an enlarged sectional view of the main portion of the wristwatch taken along line A-A in FIG. 1.
Figure 3A:
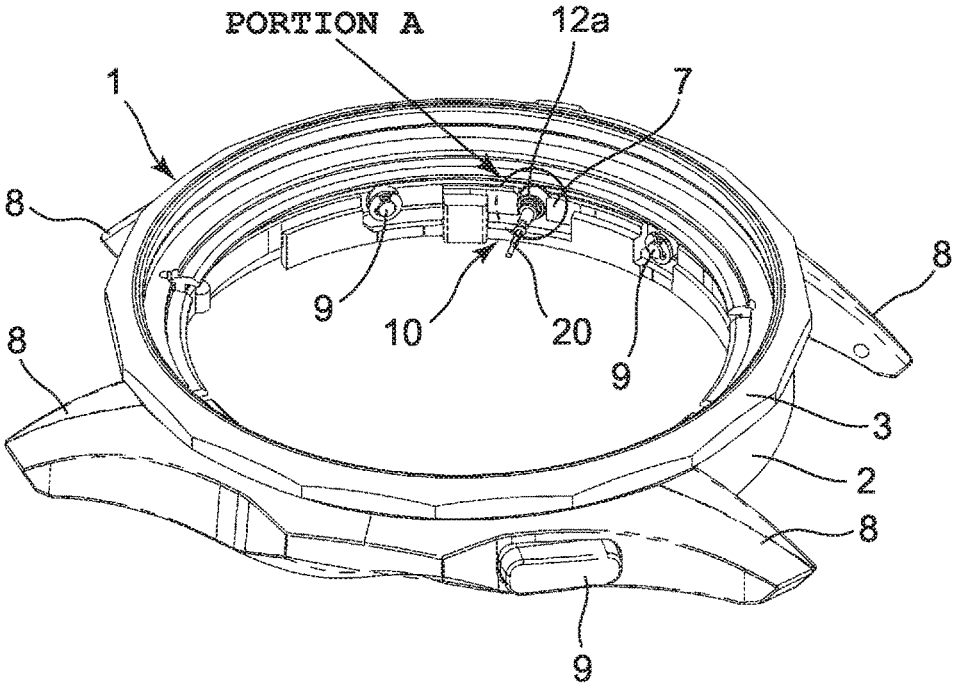
FIG. 3A is an enlarged perspective view of a wristwatch case shown in FIG. 1.
Figure 3B:
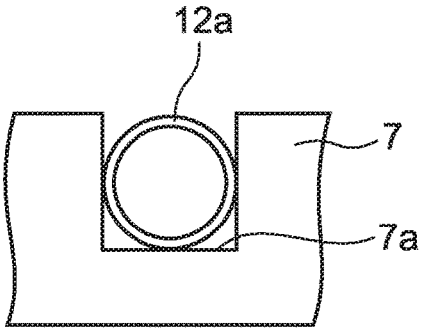
FIG. 3B is an enlarged view of portion A serving as the main portion of an inner frame arranged inside the wristwatch case shown in FIG. 1.

In this embodiment, the second case 3 is attached to the upper portion of the first case 2 via a waterproof ring 3*a*, and the outer circumference of the second case 3 slightly protrudes from the outer circumference of the first case 2 to the outside, as shown in FIG. 2 and FIG. 3A and FIG. 3B. A timepiece glass 4 is attached to the upper opening portion of this wristwatch case 1, that is, the upper opening portion of the second case 3 via a packing 4*a*. In addition, a back cover 5 is attached to the lower portion of the wristwatch case 1, that is, the lower portion of the first case 2 via a waterproof ring 5*a*.

A timepiece module 6 is arranged inside this wristwatch case 1, that is, inside the first case 2 together with an inner frame 7, as shown in FIG. 2. The timepiece module 6 includes various types of components (not shown) necessary for timepiece functions, such as a timepiece movement to drive hands and a display panel to electrooptically display information including the time.

In this embodiment, the timepiece module 6 includes a housing (not shown) which houses various types of components, and the inner frame 7 made of a synthetic resin is attached to the outer circumference of this housing and incorporated into the first case 2 in this state, as shown in FIG. 2. In addition, a dial plate (not shown) above which hands are moved is arranged on the upper surface of this timepiece module 6. Furthermore, a first parting member 3*b* and a second parting member 3*c* are provided on the inner circumferential surface of the second case 3 located above the timepiece module 6.

Figure 1:
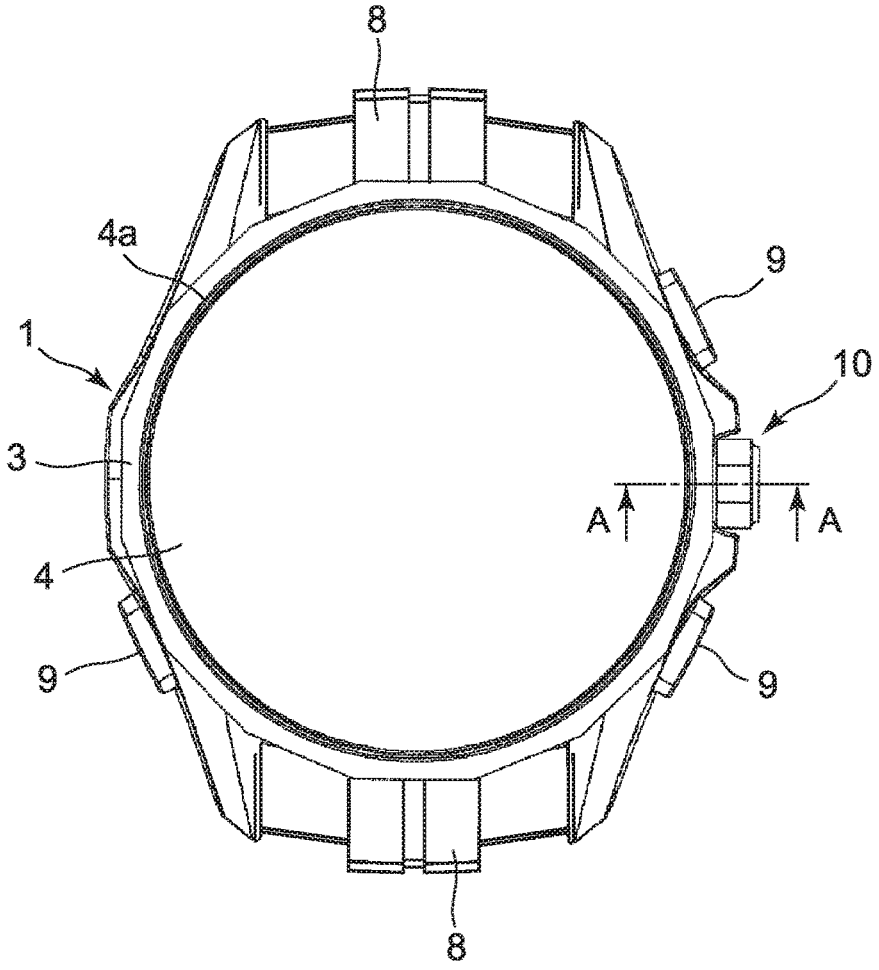
FIG. 1 is an enlarged front view of an embodiment in which the present invention has been applied in a wristwatch.

Also, band attaching sections 8 are respectively provided on the 12 o'clock side portion and the 6 o'clock side portion of the wristwatch case 1 so as to protrude outside, as shown in FIG. 1. Furthermore, push button switches 9 are respectively provided on the 2 o'clock side portion, the 4 o'clock side portion, and the 8 o'clock side portion of the wristwatch case 1, and a switch device 10 is provided on the 3 o'clock side portion of the wristwatch case 1.

As shown in FIG. 2, the switch device 10 includes a cylindrical member 12 which is fitted into a through hole 11 provided in the first case 2 of the wristwatch case 1 and protrudes inside and outside of the first case 2, and an operation member 13 which is slidably inserted into this cylindrical member 12 such that its inner end portion is inserted into the timepiece module 6 and its outer end portion holds the outer end portion of the cylindrical member 12 in a manner to slidably cover it. In this embodiment, the through hole 11 is provided in a side wall portion of the first case 2 in a manner to penetrate from the inside to the outside of the side wall portion.

As shown in FIG. 2, FIG. 4, FIG. 5A and FIG. 5B, the cylindrical member 12 includes a small diameter cylindrical section 12*a* which is press-fitted into the through hole 11 of the first case 2 and projects inside the first case 2 and a large diameter cylindrical section 12*b* which is provided on the outer end portion of this small diameter cylindrical section 12*a* and projects outside the first case 2, and these sections are integrally formed with a metal with high rigidity, such as stainless steel.

Figure 4:
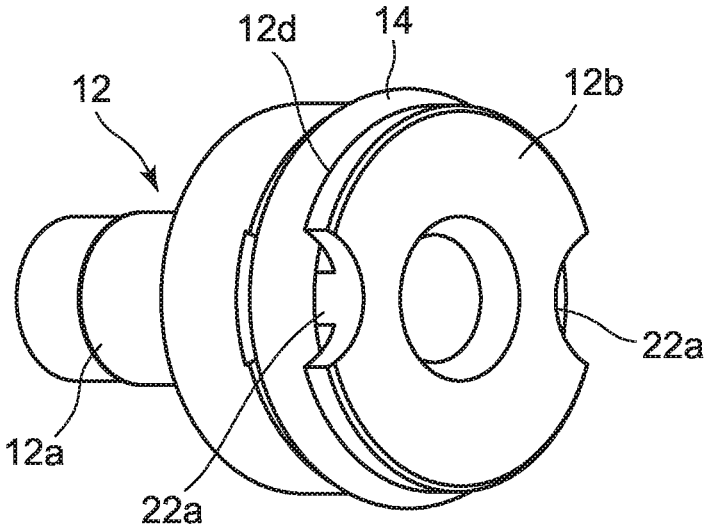
FIG. 4 is an enlarged perspective view of a cylindrical member of the switch device shown in FIG. 2.

In this embodiment, the small diameter cylindrical section 12*a* is formed having an outer diameter equal to the inner diameter of the through hole 11 of the first case 2, and is formed having a cylindrical shape as a whole, as shown in FIG. 2 and FIG. 4. This small diameter cylindrical section 12*a* is formed having an axial length longer than the axial length of the through hole 11 of the first case 2, and the inner end portion of the small diameter cylindrical section 12*a* projects inside the first case 2 and is held by the inner frame 7 of the timepiece module 6.

That is, the inner frame 7 is formed with a synthetic resin such that it has a ring shape, and arranged on the inner circumferential surface of the first case 2, as shown in FIG. 3B. This inner frame 7 is provided with a rectangular notched section 7*a* which grips and holds the inner end portion of the small diameter cylindrical section 12*a* from the radial direction. This notched section 7*a* is formed such that the length of the inner frame 7 in the circumferential direction and the length thereof in the vertical direction are substantially equal to the outer diameter of the inner end portion of the small diameter cylindrical section 12*a*, and its upper portion is opened.

As a result, the small diameter cylindrical section 12*a* is structured such that, when the timepiece module 6 is to be incorporated in the first case 2 together with the inner frame 7 with the small diameter cylindrical section 12*a* being inserted into the through hole 11 of the first case 2 and the inner end portion projecting inside the first case 2, the inner end portion projecting inside the first case 2 is fitted into the notched section 7*a* of the inner frame 7 from the upper side, whereby the inner end portion is interposed between and held by the side portions of the notched section 7*a* with the inner end portion being in contact with the bottom side portion of the notched section 7*a*, as shown in FIG. 2 and FIG. 3B.

Accordingly, this small diameter cylindrical section 12*a* is press-fitted into the through hole 11 of the first case 2, and the inner end portion is fitted into the notched section 7*a* of the inner frame 7 of the timepiece module 6 arranged in the first case 2, so that the small diameter cylindrical section 12*a* is attached to the first case 2 by two-point support, as shown in FIG. 2, FIG. 3A and FIG. 3B.

The large diameter cylindrical section 12*b* is formed having an outer diameter substantially equal to the height of the first case 2 in the vertical direction thereof and larger than the outer diameter of the small diameter cylindrical section 12*a*, as shown in FIG. 2, FIG. 4, FIG. 5A and FIG. 5B. This large diameter cylindrical section 12*b* has an inner diameter equal to the inner diameter of the small diameter cylindrical section 12*a*, and is formed corresponding to the small diameter cylindrical section 12*a* on the same axis.

In addition, this large diameter cylindrical section 12*b* is formed having an axial length substantially equal to or slightly shorter than the axial length of the small diameter cylindrical section 12*a*, as shown in FIG. 2, FIG. 4, FIG. 5A and FIG. 5B. Furthermore, this cylindrical member 12 is structured to have a boundary section 12*c* between the small diameter cylindrical section 12*a* and the large diameter cylindrical section 12*b*. This boundary section 12*c* is structured such that its inner end portion located on the inner side of the first case 2 is in contact with the outer circumferential surface of the first case 2.

As a result, the small diameter cylindrical section 12*a* is press-inserted into and held in the through hole 11 of the first case 2, the inner end portion of the small diameter cylindrical section 12*a* is fitted into and held in the notched section 7*a* of the inner frame 7 of the timepiece module 6, and the boundary section 12*c* between the small diameter cylindrical section 12*a* and the large diameter cylindrical section 12*b* comes in contact with the outer circumferential surface of the first case 2, whereby the cylindrical member 12 is firmly attached to the first case 2 such that it is not rotated around the first case 2, as shown in FIG. 2 and FIG. 4.

In addition, in the outer circumferential surface of the large diameter cylindrical section 12*b* of this cylindrical member 12, a mounting groove 12*d* where an elastic retaining member 14 is mounted is annularly provided, as shown in FIG. 2, FIG. 4, FIG. 5A and FIG. 5B. The elastic retaining member 14 is formed of an elastic material such as rubber such that it has a ring shape. This elastic retaining member 14 is structured such that, when it is attached to the mounting groove 12*d* of the large diameter cylindrical section 12*b*, its outer circumference portion protrudes from the outer circumferential surface of the large diameter cylindrical section 12*b*.

Figure 6:
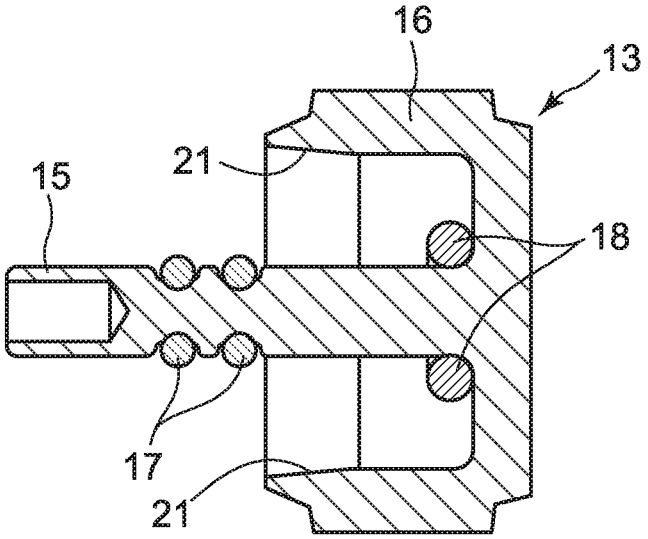
FIG. 6 is an enlarged sectional view of an operation member of the switch device shown in FIG. 2.

The operation member 13 includes a shaft section 15 which is slidably inserted into the cylindrical member 12, and a head section 16 which is provided on the outer end portion of this shaft section 15, as shown in FIG. 2 and FIG. 6. The shaft section 15 is formed having a round bar shape, and is slidably and rotatably inserted into the cylindrical member 12. This shaft section 15 is formed having an outer diameter substantially equal to the inner diameter of the small diameter cylindrical section 12*a* of the cylindrical member 12 and an axial length slightly longer than the axial length of the cylindrical member 12.

In this embodiment, on the outer circumference of the shaft section 15, a plurality of waterproof rings 17 is annularly provided, as shown in FIG. 2 and FIG. 6. The plurality of waterproof rings 17 is structured to slide with them being in pressure contact with the inner circumferential surface of the small diameter cylindrical section 12*a* of the cylindrical member 12, so that waterproofing between the outer circumferential surface of the shaft section 15 and the inner circumferential surface of the small diameter cylindrical section 12*a* of the cylindrical member 12 is achieved. In addition, on the outer end portion of the shaft section 15, the head section 16 is integrally provided.

The head section 16 is formed in the shape of a cylindrical cap to cover the large diameter cylindrical section 12*b* of the cylindrical member 12, as shown in FIG. 2 and FIG. 6. This head section 16 is formed having an axial length longer than the axial length of the large diameter cylindrical section 12*b*. In addition, this head section 16 is formed having an inner diameter slightly larger than the outer diameter of the large diameter cylindrical section 12*b*, and the outer circumference portion of the elastic retaining member 14 attached to the mounting groove 12*d* of the large diameter cylindrical section 12*b* slidably comes in elastic contact with the head section 16.

As a result, the head section 16 is structured such that the outer circumference portion of the elastic retaining member 14 attached to the mounting groove 12*d* of the large diameter cylindrical section 12*b* is in elastic contact with the inner circumferential surface of the head section 16, whereby the head section 16 slidably and rotatably holds the large diameter cylindrical section 12*b* together with the shaft section 15 inserted into the cylindrical member 12, as shown in FIG. 2 and FIG. 6.

Accordingly, the cylindrical member 12 is structured such that the small diameter cylindrical section 12*a* is inserted into and held in the through hole 11 of the first case 2, the inner end portion of the small diameter cylindrical section 12*a* is fitted into and held in the notched section 7*a* of the inner frame 7 of the timepiece module 6, and the large diameter cylindrical section 12*b* is held by the head section 16, whereby the cylindrical member 12 is attached to the first case 2 with it being held at three points, as shown in FIG. 2.

In this embodiment, the elastic retaining member 14 is structured to be in elastic contact with the inner circumferential surface of the head section 16 of the operation member 13 as shown in FIG. 2, so that centering of the large diameter cylindrical section 12*b* of the cylindrical member 12 and the operation member 13 is performed to prevent both of them from being eccentric, and waterproofing between the outer circumferential surface of the large diameter cylindrical section 12*b* of the cylindrical member 12 and the inner circumferential surface of the head section 16 is achieved.

In addition, inside this head section 16, a buffer member 18 which separably comes into contact with the outer end surface of the large diameter cylindrical section 12*b* of the cylindrical member 12 is provided, as shown in FIG. 2 and FIG. 6. This buffer member 18, which is formed of an elastic material such as rubber, has a ring shape, and is structured to buffer an impact in the axial direction of the operation member 13. That is, this buffer member 18 is formed to have an inner diameter substantially equal to the outer diameter of the shaft section 15, and is arranged between the inner end surface of the head section 16 and the outer end surface of the large diameter cylindrical section 12*b* with it being mounted in the outer circumference of the shaft section 15.

As a result, the operation member 13 is structured such that the shaft section 15 is inserted into the inside of the cylindrical member 12 in a manner to be slidable and rotatable in the axial direction, and the head section 16 is arranged in a manner to be slidable and rotatable in the axial direction with it covering the large diameter cylindrical section 12*b* of the cylindrical member 12, whereby the operation member 13 slides along and rotates around the axial direction of the cylindrical member 12, as shown in FIG. 2 and FIG. 6.

In addition, in the operation member 13, a stem 20 is attached to the inner end portion of the shaft section 15, as shown in FIG. 2. This stem 20 is structured to be inserted into the timepiece module 6 provided in the first case 2, and thereby coupled to the timepiece movement (not shown) inside the timepiece module 6. That is, this stem 20 is structured to slide in accordance with the sliding movement of the operation member 13 and rotate in accordance with the rotation operation of the operation member 13.

As a result, in a first state where the operation member 13 has been pressed into the inside of the first case 2, when the stem 20 slides together with the operation member 13 and the inner end portion of the stem 20 is pressed into the inside of the timepiece movement, a neutral state is achieved in which the timepiece movement does not operate even if the stem 20 is rotated in accordance with the rotation operation of the operation member 13, as shown in FIG. 2.

In addition, in a second state where the operation member 13 has been pulled out toward the outside of the first case 2 in the state shown in FIG. 2, when the stem 20 slides in accordance with the sliding movement of the operation member 13 so as to achieve a state in which the inner end portion of the stem 20 can operate the timepiece movement, the timepiece movement can be operated to make time correction by the stem 20 rotating in accordance with the rotation operation of the operation member 13.

In addition, this operation member 13 is structured such that an elastic contact adjustment section 21 is provided on the inner circumferential surface of the head section 16, and the elastic retaining member 14 comes in elastic contact with this elastic contact adjustment section 21, as shown in FIG. 2 and FIG. 6. This elastic contact adjustment section 21 is structured such that the elastic contact force of the elastic retaining member 14 when the operation member 13 is located at the second position by being pulled out toward the outside of the first case 2 is made smaller than the elastic contact force of the elastic retaining member 14 when the operation member 13 is located at the first position by being pressed into the inside of the first case 2.

That is, this elastic contact adjustment section 21 is formed on a tapered surface in which the inner diameter of the head section 16 of the operation member 13 gradually becomes larger from the first position toward the second position, as shown in FIG. 2 and FIG. 6. In this embodiment, the elastic contact adjustment section 21 is structured such that the tapered surface is inclined within a range of the protrusion length of the elastic retaining member 14 from the outer circumferential surface of the large diameter cylindrical section 12*b* of the cylindrical member 12.

As a result, the elastic contact adjustment section 21 is structured such that the elastic force of the elastic retaining member 14 is large in the first state in which the operation member 13 has been pressed into the inside of the first case 2, and the elastic force of the elastic retaining member 14 gradually becomes smaller in accordance with the sliding movement of the operation member 13 when the operation member 13 is pulled out toward the outside of the first case 2 to slide to the second position, as shown in FIG. 2 and FIG. 6.

Figure 5A:
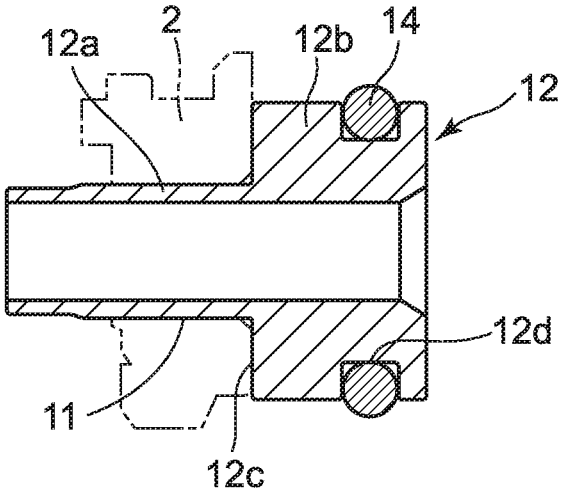
FIG. 5A is an enlarged sectional view of the cylindrical member shown in FIG. 4.
Figure 5B:
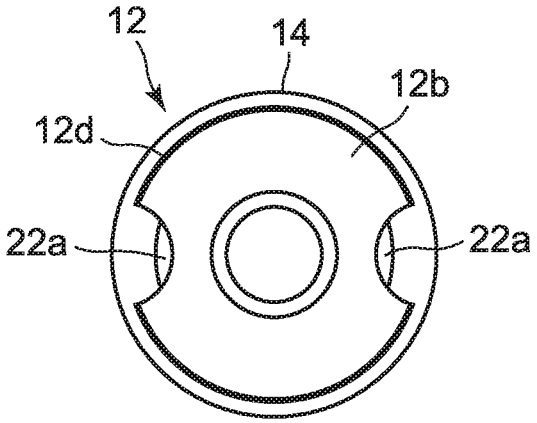
FIG. 5B is an enlarged right side view of the cylindrical member shown in FIG. 4.

The cylindrical member 12 is provided with a circulation path 22 for communication between the outside of the first case 2 and a space enclosed by the large diameter cylindrical section 12*b* and the head section 16 of the operation member 13 inside the large diameter cylindrical section 12*b*, as shown in FIG. 4, FIG. 5A and FIG. 5B. That is, this circulation path 22 includes a pair of notched groove sections 22*a* formed in an outer circumference portion of the large diameter cylindrical section 12*b* of the cylindrical member 12 along the axial direction through the inner circumference side of the elastic retaining member 14, and a circulation section 22*b* provided between the inner circumferential surface of the head section 16 and the outer circumferential surface of the large diameter cylindrical section 12*b*.

Each of the pair of notched groove sections 22*a* is a semicircular groove and formed from an outer end portion of the large diameter cylindrical section 12*b* of the cylindrical member 12 through the mounting groove 12*d* of the large diameter cylindrical section 12*b* and located almost over the middle portion of the large diameter cylindrical section 12*b* in the axial direction thereof, as shown in FIG. 4 and FIG. 5B. In this embodiment, the pair of notched groove sections 22*a* is formed having a depth deeper than the depth of the mounting groove 12*d* of the large diameter cylindrical section 12*b*.

Accordingly, each of the pair of notched groove sections 22*a* is structured such that a gap is formed between an inner circumference portion of the elastic retaining member 14 mounted in the mounting groove 12*d* of the large diameter cylindrical section 12*b* and a bottom portion of the pair of notched groove sections 22, and fluid such as air or water circulates through this gap, as shown in FIG. 5B.

As a result, the circulation path 22 is structured such that, when the head section 16 of the operation member 13 is pressed into the inside of the first case 2, a fluid such as air or water in the space enclosed by the large diameter cylindrical section 12*b* of the cylindrical member 12 and the head section 16 inside the large diameter cylindrical section 12*b* is compressed, and discharged to the outside of the first case 2, so that pressure in the space enclosed by the large diameter cylindrical section 12*b* and the head section 16 inside the large diameter cylindrical section 12*b* is made substantially equal to the pressure of the outside of the first case 2, as shown in FIG. 2, FIG. 4, and FIG. 5B.

In addition, this circulation path 22 is structured such that, when the head section 16 of the operation member 13 is pulled out toward the outside of the first case 2, a fluid such as air or water in the space enclosed by the large diameter cylindrical section 12*b* and the head section 16 inside the large diameter cylindrical section 12*b* expands, whereby a fluid such as air or water outside the first case 2 is sent into the space enclosed by the large diameter cylindrical section 12*b* and the head section 16 inside the large diameter cylindrical section 12*b*, and pressure in the space enclosed by the large diameter cylindrical section 12*b* and the head section 16 inside the large diameter cylindrical section 12*b* is made substantially equal to the pressure of the outside of the first case 2, as shown in FIG. 2, FIG. 4, and FIG. 5B.

Next, the operation of the switch device 10 in the wristwatch is described.

In a normal state of this switch device 10, the operation member 13 has been pressed into the inside of the first case 2 and arranged in the first position shown in FIG. 2. In this state, the elastic retaining member 14 provided in the large diameter cylindrical section 12*b* of the cylindrical member 12 is in strong elastic contact with a portion having the smallest inner diameter in the tapered surface of the elastic contact adjustment section 21 provided on the inner circumferential surface of the head section 16 of the operation member 13.

Accordingly, waterproofing between the large diameter cylindrical section 12*b* of the cylindrical member 12 and the head section 16 of the operation member 13 has been achieved. Also, here, the buffer member 18 has been elastically held between the inner end surface of the head section 16 of the operation member 13 and the outer end surface of the large diameter cylindrical section 12*b* of the cylindrical member 12. In addition, the stem 20 attached to the shaft section 15 of the operation member 13 has been pressed inside the timepiece movement (not shown) of the timepiece module 6. This state is a neutral state in which, even when the stem 20 rotates in accordance with the rotation operation of the operation member 13, the timepiece movement does not operate.

In this state, when the head section 16 of the operation member 13 receives an impact from the outside thereof, the impact from the outside is buffered by the elastic retaining member 14 attached to the mounting groove 12*d* of the large diameter cylindrical section 12*b* of the cylindrical member 12 and by the buffer member 18 located in the outer circumference of the shaft section 15 of the operation member 13 and arranged between the outer end surface of the head section 16 and the inner end surface in the large diameter cylindrical section 12*b*.

That is, when the head section 16 of the operation member 13 receives an impact in a direction perpendicular to the axial direction thereof, the impact from the outside is buffered by the elastic retaining member 14 attached to the mounting groove 12*d* of the large diameter cylindrical section 12*b* of the cylindrical member 12. On the other hand, when the head section 16 of the operation member 13 receives an impact in the axial direction thereof, the impact from the outside is buffered by the buffer member 18 arranged between the outer end surface of the head section 16 and the inner end surface in the large diameter cylindrical section 12*b*. Accordingly, when the head section 16 receives an impact in a direction oblique to the axial direction thereof, the impact is buffered by the elastic retaining member 14 and the buffer member 18.

When the timepiece movement (not shown) of the timepiece module 6 is to be operated to make time correction, first, the operation member 13 is pulled out toward the outside of the first case 2 and arranged in the second position. Here, the head section 16 of the operation member 13 is pulled out toward the outside of the first case 2. Then, the shaft section 15 of the operation member 13 slides in the cylindrical member 12 to be pulled out toward the outside of the first case 2, and the head section 16 slides along the outer circumference of the large diameter cylindrical section 12*b* of the cylindrical member 12 to be pulled out toward the outside of the first case 2.

That is, when the shaft section 15 of the operation member 13 is pulled out toward the outside of the first case 2, the plurality of waterproof rings 17 provided in the outer circumference of the shaft section 15 slides with them being in pressure contact with the inner circumferential surface of the cylindrical member 12. As a result, waterproofing between the outer circumferential surface of the shaft section 15 and the inner circumferential surface of the cylindrical member 12 is achieved. In addition, when the head section 16 is pulled out toward the outside of the first case 2, the elastic retaining member 14 of the large diameter cylindrical section 12*b* of the cylindrical member 12 slides with it being in elastic contact with the elastic contact adjustment section 21 provided on the inner circumferential surface of the head section 16, whereby waterproofing between the inner circumferential surface of the head section 16 and the outer circumferential surface of the large diameter cylindrical section 12*b* of the cylindrical member 12 is achieved.

Here, the elastic contact adjustment section 21 provided on the inner circumferential surface of the head section 16 has been formed on the tapered surface which gradually becomes larger from the first position where the operation member 13 is in a pressed-in state toward the second position where the operation member 13 is in a pulled-out state. As a result, the elastic force of the elastic retaining member 14 which comes into elastic contact with the elastic contact adjustment section 21 provided on the inner circumferential surface of the head section 16 gradually becomes smaller in accordance with the pulling-out operation of the operation member 13.

That is, at the first position where the operation member 13 is in a state of being pressed into the inside of the first case 2, the elastic force of the elastic retaining member 14 which comes in elastic contact with the elastic contact adjustment section 21 of the head section 16 reaches the maximum. On the other hand, at the second position where the operation member 13 is in a state of being pulled out toward the outside of the first case 2, the elastic force of the elastic retaining member 14 which comes in elastic contact with the elastic contact adjustment section 21 of the head section 16 gradually becomes smaller. As a result, when the operation member 13 is pulled out toward the outside of the first case 2, the pulling-out operation force gradually becomes smaller.

Here, since the tapered surface of the elastic contact adjustment section 21 is inclined within a range of the protrusion length of the elastic retaining member 14 from the outer circumference of the large diameter cylindrical section 12*b* of the cylindrical member 12, even when the pulling-out operation force of the operation member 13 gradually becomes smaller, the elastic retaining member 14 of the large diameter cylindrical section 12*b* of the cylindrical member 12 slides with it being in elastic contact with the elastic contact adjustment section 21 provided on the inner circumferential surface of the head section 16. As a result, waterproofing between the inner circumferential surface of the head section 16 and the outer circumferential surface of the large diameter cylindrical section 12*b* of the cylindrical member 12 is achieved.

In addition, when the operation member 13 is pulled out, a fluid such as air or water in the space enclosed by the large diameter cylindrical section 12*b* of the cylindrical member 12 and the head section 16 of the operation member 13 inside the large diameter cylindrical section 12*b* expands. Accordingly, a fluid such as air or water outside the first case 2 is fed into the space enclosed by the large diameter cylindrical section 12*b* and the head section 16 inside the large diameter cylindrical section 12*b* via the circulation path 22 provided between the large diameter cylindrical section 12*b* and the head section 16.

That is, a fluid such as air or water outside the first case 2 is fed into the space enclosed by the large diameter cylindrical section 12*b* and the head section 16 inside the large diameter cylindrical section 12*b*, from the circulation section 22*b* provided between the inner circumferential surface of the head section 16 and the outer circumferential surface of the large diameter cylindrical section 12*b* via the pair of notched groove sections 22*a* formed in the outer circumference portion of the large diameter cylindrical section 12*b* of the cylindrical member 12 along the axial direction through the inner circumference side of the elastic retaining member 14.

As a result, pressure in the space enclosed by the large diameter cylindrical section 12*b* and the head section 16 of the operation member 13 inside the large diameter cylindrical section 12*b* becomes substantially equal to the pressure of the outside of the first case 2, which allows the operation member 13 to slide smoothly and favorably along the cylindrical member 12 toward the outside portion side of the first case 2 when the operation member 13 is pulled out.

When the operation member 13 is pulled out as described above, the stem 20 attached to the shaft section 15 of the operation member 13 slides in accordance with the sliding movement of the operation member 13 so as to achieve a state in which the inner end portion of the stem 20 can operate the timepiece movement (not shown) of the timepiece module 6. When the rotation operation of the head section 16 of the operation member 13 is performed in this state, the stem 20 rotates in accordance with this rotation operation of the head section 16, and the timepiece movement is operated by this rotation of the stem 20 to make time correction.

Here, the operation member 13 is pulled out, whereby the elastic force of the elastic retaining member 14 which comes in elastic contact with the elastic contact adjustment section 21 of the head section 16 becomes smaller. Therefore, the head section 16 can be smoothly and favorably rotated with a small force when the rotation operation of the head section 16 of the operation member 13 is performed. Accordingly, the operability of the operation member 13 is improved, and the operation member 13 can be favorably operated.

Then, when the operation member 13 is to be pressed into the inside of the first case 2 to return to the normal initial state again, the head section 16 of the operation member 13 is pressed toward the inner side of the first case 2 and arranged in the first position shown in FIG. 2. Here, the shaft section 15 of the operation member 13 slides inside the cylindrical member 12 and pressed into the inside of the first case 2, and the head section 16 slides along the outer circumference of the large diameter cylindrical section 12*b* of the cylindrical member 12 and pressed into the inside of the first case 2.

That is, when the shaft section 15 of the operation member 13 is pressed into the inside of the first case 2, the plurality of waterproof rings 17 provided in the outer circumference of the shaft section 15 slides with them being in pressure contact with the inner circumferential surface of the cylindrical member 12. In addition, when the head section 16 is pressed into the inside of the first case 2, the elastic retaining member 14 of the large diameter cylindrical section 12*b* of the cylindrical member 12 slides with it being in elastic contact with the elastic contact adjustment section 21 provided on the inner circumferential surface of the head section 16.

Here, the elastic force of the elastic retaining member 14 which comes in elastic contact with the elastic contact adjustment section 21 of the head section 16 gradually becomes larger in accordance with the press-in operation of the operation member 13. That is, at the second position where the operation member 13 is in a state of being pulled out toward the outside of the first case 2, the elastic force of the elastic retaining member 14 which comes in elastic contact with the elastic contact adjustment section 21 of the head section 16 is smallest.

Accordingly, at the first position where the operation member 13 is in a state of being pressed into the inside of the first case 2, the elastic force of the elastic retaining member 14 which comes in elastic contact with the elastic contact adjustment section 21 of the head section 16 is largest. As a result, when the operation member 13 is pressed into the inside of the first case 2, the press-in operation force gradually becomes larger.

In addition, when the operation member 13 is pressed into the inside of the first case 2 as described above, a fluid such as air or water in the space enclosed by the large diameter cylindrical section 12*b* of the cylindrical member 12 and the head section 16 of the operation member 13 inside the large diameter cylindrical section 12*b* is compressed, and discharged to the outside of the first case 2 through the circulation path 22 provided in the large diameter cylindrical section 12*b*.

That is, a fluid such as air or water in the space enclosed by the large diameter cylindrical section 12*b* and the head section 16 inside the large diameter cylindrical section 12*b* is discharged to the outside of the first case 2 through the circulation section 22*b* provided between the inner circumferential surface of the head section 16 and the outer circumferential surface of the large diameter cylindrical section 12*b*, from the pair of notched groove sections 22*a* formed in the outer circumference portion of the large diameter cylindrical section 12*b* of the cylindrical member 12 along the axial direction through the inner circumference side of the elastic retaining member 14.

As a result, pressure in the space enclosed by the large diameter cylindrical section 12*b* and the head section 16 inside the large diameter cylindrical section 12*b* becomes substantially equal to the pressure of the outside of the first case 2, which allows the operation member 13 to smoothly and favorably slide toward the inner side of the first case 2. Then, when the operation member 13 is pressed in, the operation member 13 returns to its normal initial state, whereby the neutral state is achieved in which the timepiece movement does not operate even when the rotation operation of the operation member 13 is performed.

As described above, the switch device 10 of this wristwatch includes the cylindrical member 12 which is attached to the through hole 11 of the wristwatch case 1 having the built-in timepiece module 6 and of which the inner end portion projects inside the wristwatch case 1 to be held in the timepiece module 6 and the outer end portion projects outside the wristwatch case 1; and the operation member 13 which includes the shaft section 15 arranged in the cylindrical member 12 in a manner to be slidable in the axial direction thereof to operate the timepiece module 6, and the head section 16 provided in the outer end portion of the shaft section 15 to cover and slidably hold the outer end portion of the cylindrical member 12. As a result, the outer diameter of the cylindrical member 12 and the inner diameter of the through hole 11 of the wristwatch case 1 can be made smaller, whereby the wristwatch case 1 can be made thinner.

That is, this switch device 10 of the wristwatch allows the cylindrical member 12 to be held at three points, namely, the through hole 11 of the wristwatch case 1, the timepiece module 6, and the operation member 13, and therefore the cylindrical member 12 can be unfailingly and firmly held in the wristwatch case 1 in a stable state. Accordingly, the outer diameter of the cylindrical member 12 can be formed to be smaller by about 20%. In addition, even though the outer diameter of the cylindrical member 12 is formed smaller, the strength of the cylindrical member 12 can be ensured, and the inner diameter of the through hole 11 of the wristwatch case 1 can be formed smaller in accordance with the outer diameter of the cylindrical member 12. As a result, the thickness of the wristwatch case 1 can be made thinner by about 10%, whereby the wristwatch case 1 can be made thinner.

In this embodiment, the cylindrical member 12 includes the small diameter cylindrical section 12*a* which is inserted into and held in the through hole 11 of the wristwatch case 1 and of which the inner end portion projects inside the wristwatch case 1 and is held in the timepiece module 6; and the large diameter cylindrical section 12*b* which is provided in the outer end portion of the small diameter cylindrical section 12*a* and held by the head section 16 of the operation member 13. As a result, the cylindrical member 12 can be held at three points, namely, the through hole 11 of the wristwatch case 1, the timepiece module 6, and the operation member 13, whereby the cylindrical member 12 can be unfailingly and firmly held in the wristwatch case 1.

In this embodiment, the timepiece module 6 includes the inner frame 7 attached to the outer circumference of a housing that houses various types of components necessary for timepiece functions, and the inner end portion of the cylindrical member 12 projecting inside the wristwatch case 1 is gripped by and held in the notched section 7*a* provided in the inner frame 7, and as a result the inner end portion of the cylindrical member 12 can be unfailingly held. That is, the notched section 7*a* of the inner frame 7 is formed such that the length of the inner frame 7 in the circumferential direction and the length thereof in the vertical direction are substantially equal to the outer diameter of the inner end portion of the small diameter cylindrical section 12*a*, and the upper side of the notched section 7*a* is opened. Accordingly, the inner end portion of the cylindrical member 12 can be unfailingly held.

As a result, when the timepiece module 6 and the inner frame 7 are to be mounted in the wristwatch case 1 with the small diameter cylindrical section 12*a* being inserted into the through hole 11 of the wristwatch case 1 such that the inner end portion projects inside the wristwatch case 1, the inner end portion projecting inside the wristwatch case 1 is fitted into the notched section 7*a* of the inner frame 7 from the upper side thereof, whereby the inner end portion of the small diameter cylindrical section 12*a* can be brought into contact with the bottom-side portion of the notched section 7*a* and unfailingly gripped and held by the side portions of the notched section 7*a*.

Accordingly, the small diameter cylindrical section 12*a* of the cylindrical member 12 is press-fitted into the through hole 11 of the wristwatch case 1 and fixed thereto, and the inner end portion is fitted into and fixed to the notched section 7*a* of the inner frame 7 of the timepiece module 6 arranged in the wristwatch case 1. As a result, the small diameter cylindrical section 12*a* can be unfailingly and firmly held in the wristwatch case 1 at two points.

Also, this switch device 10 includes the elastic retaining member 14 which is provided in the outer circumference of the large diameter cylindrical section 12*b* of the cylindrical member 12 so as to protrude in the radial direction, and holds the large diameter cylindrical section 12*b* of the cylindrical member 12 with this protruded large diameter cylindrical section 12*b* being in elastic contact with the inner circumferential surface of the head section 16 of the operation member 13. Accordingly, the large diameter cylindrical section 12*b* of the cylindrical member 12 can be favorably held by the head section 16 of the operation member 13 via the elastic retaining member 14 which comes in elastic contact with the inner circumferential surface of the head section 16 of the operation member 13.

That is, in this structure, the shaft section 15 of the operation member 13 is inserted into the cylindrical member 12 to be held, the head section 16 is provided in the outer end portion of this shaft section 15, and the elastic retaining member 14 is in elastic contact with the inner circumferential surface of this head section 16. As a result, the head section 16 of the operation member 13 can unfailingly hold the large diameter cylindrical section 12*b* of the cylindrical member 12, together with the shaft section 15. Accordingly, even though the large diameter cylindrical section 12*b* of the cylindrical member 12 is provided with it projecting outside the wristwatch case 1, the large diameter cylindrical section 12*b* can be unfailingly and favorably held in a stable state.

In this embodiment, the mounting groove 12*d* to which the elastic retaining member 14 is attached is provided on the outer circumferential surface of the large diameter cylindrical section 12*b* of the cylindrical member 12. When the elastic retaining member 14 is attached to the mounting groove 12*d*, the outer circumference portion of the elastic retaining member 14 protrudes from the outer circumferential surface of the large diameter cylindrical section 12*b*. As a result, when the head section 16 of the operation member 13 receives impacts, an impact in a direction perpendicular to the axial direction of the head section 16 can be buffered by the elastic retaining member 14 protruding from the outer circumferential surface of the large diameter cylindrical section 12*b*.

In addition, since the outer circumference portion of this elastic retaining member 14 protrudes from the outer circumferential surface of the large diameter cylindrical section 12*b*, centering of the large diameter cylindrical section 12*b* of the cylindrical member 12 and the operation member 13 can be performed, whereby both the large diameter cylindrical section 12*b* and the operation member 13 can be prevented from being eccentric, and waterproofing between the outer circumferential surface of the large diameter cylindrical section 12*b* of the cylindrical member 12 and the inner circumferential surface of the head section 16 can be achieved.

Also, in this switch device 10, the buffer member 18 is arranged between the inner end surface in the head section 16 of the operation member 13 and the outer end surface of the large diameter cylindrical section 12*b* of the cylindrical member 12. As a result, when the head section 16 of the operation member 13 receives impacts, an impact in the axial direction of the head section 16 can be buffered by the buffer member 18. Accordingly, when the head section 16 receives an impact in a direction oblique to the axial direction thereof, the impact can be buffered by the elastic retaining member 14 and the buffer member 18.

Moreover, this switch device 10 includes the elastic contact adjustment section 21 which is provided on the inner circumferential surface of the head section 16 of the operation member 13 and by which the elastic force of the elastic retaining member 14 when the operation member 13 is located at the second position by being pulled out toward the outside of the wristwatch case 1 is made smaller than the elastic force of the elastic retaining member 14 when the operation member 13 is located at the first position by being pressed into the inside of the wristwatch case 1. As a result, the operability of the operation member 13 can be improved.

That is, in this switch device 10, when the operation member 13 is arranged at the second position by being pulled out toward the outside of the wristwatch case 1, the elastic force of the elastic retaining member 14 which comes in elastic contact with the elastic contact adjustment section 21 provided on the inner circumferential surface of the head section 16 can be made smaller. Accordingly, the rotation operation of the head section 16 of the operation member 13 can be performed with a small force. As a result, the rotation operability of the head section 16 can be improved.

Furthermore, in this switch device 10, when the operation member 13 is arranged at the first position by being pressed into the inside of the wristwatch case 1, the elastic force of the elastic retaining member 14 which comes in elastic contact with the elastic contact adjustment section 21 provided on the inner circumferential surface of the head section 16 becomes larger. Accordingly, the rotation force of the head section 16 of the operation member 13 becomes larger, whereby the head section 16 can be prevented from accidentally rotating.

In this embodiment, the elastic contact adjustment section 21 is formed on the tapered surface where the inner diameter of the head section 16 of the operation member 13 gradually becomes larger from the first position toward the second position. As a result, when the operation member 13 is pulled out toward the outside of the wristwatch case 1, the elastic force of the elastic retaining member 14 which comes in elastic contact with the elastic contact adjustment section 21 gradually becomes smaller in accordance with the pulling-out operation of the operation member 13, whereby the pulling-out operability of the operation member 13 can be improved.

In addition, when the operation member 13 is pressed into the inside of the wristwatch case 1, the elastic contact adjustment section 21 gradually increases the elastic force of the elastic retaining member 14 which comes in elastic contact with the elastic contact adjustment section 21, in accordance with the press-in operation of the operation member 13. As a result, when the operation member 13 is pressed in, the operation member 13 is unfailingly and favorably fixed to the large diameter cylindrical section 12*b* of the cylindrical member 12.

In this embodiment, the tapered surface of the elastic contact adjustment section 21 is inclined within a range of the protrusion length of the elastic retaining member 14 from the outer circumference of the large diameter cylindrical section 12*b* of the cylindrical member 12. As a result, when the operation member 13 is pulled out toward the outside of the wristwatch case 1 and when the operation member 13 is pressed into the inside of the wristwatch case 1, the elastic retaining member 14 is unfailingly and favorably brought into elastic contact with the elastic contact adjustment section 21. As a result, waterproofing between the outer circumferential surface of the large diameter cylindrical section 12*b* of the cylindrical member 12 and the inner circumferential surface of the head section 16 can be favorably achieved.

Still further, this switch device 10 includes the circulation path 22 communicating between the outside of the wristwatch case 1 and the space enclosed by the outer end portion of the large diameter cylindrical section 12*b* of the cylindrical member 12 and the head section 16 of the operation member 13 inside the head section 16. As a result, when the operation member 13 is pulled out toward the outside of the wristwatch case 1 and when the operation member 13 is pressed into the inside of the wristwatch case 1, pressure in the space enclosed by the outer end portion of the large diameter cylindrical section 12*b* of the cylindrical member 12 and the head section 16 of the operation member 13 inside the head section 16 can be maintained at a level substantially equal to that of the pressure of the outside of wristwatch case 1.

That is, the circulation path 22 includes the pair of notched groove sections 22*a* formed in the outer circumference portion of the large diameter cylindrical section 12*b* of the cylindrical member 12 along the axial direction through the inner circumference side of the elastic retaining member 14, and the circulation section 22*b* provided between the inner circumferential surface of the head section 16 and the outer circumferential surface of the large diameter cylindrical section 12*b*. Accordingly, a fluid such as air or water can be unfailingly and favorably circulated from the outside of the wristwatch case 1 to and through the space enclosed by the outer end portion of the large diameter cylindrical section 12*b* of the cylindrical member 12 and the head section 16 of the operation member 13 inside the head section 16.

As a result, in this switch device 10, even if a fluid such as air or water in the space enclosed by the large diameter cylindrical section 12*b* and the head section 16 inside the large diameter cylindrical section 12*b* is compressed when the head section 16 of the operation member 13 is pressed into the inside of the wristwatch case 1, this compressed fluid can be discharged to the outside of the wristwatch case 1 by the circulation path 22 of the large diameter cylindrical section 12*b*.

Accordingly, in this switch device 10, pressure in the space enclosed by the large diameter cylindrical section 12*b* and the head section 16 inside the large diameter cylindrical section 12*b* can be made substantially equal to the pressure of the outside of the wristwatch case 1. As a result, when the head section 16 of the operation member 13 is pressed toward the inner portion side of the wristwatch case 1, the operation member 13 can slide smoothly and favorably.

Yet still further, in this switch device 10, when the head section 16 of the operation member 13 is pulled out toward the outside of the wristwatch case 1 and a fluid such as air or water in the space enclosed by the large diameter cylindrical section 12*b* of the cylindrical member 12 and the head section 16 inside the large diameter cylindrical section 12*b* expands, a fluid such as air or water outside the wristwatch case 1 is fed into the space enclosed by the large diameter cylindrical section 12*b* and the head section 16 inside the large diameter cylindrical section 12*b*, by the circulation path 22 of the large diameter cylindrical section 12*b*.

Accordingly, in this switch device 10, pressure in the space enclosed by the large diameter cylindrical section 12*b* and the head section 16 inside the large diameter cylindrical section 12*b* can be made substantially equal to the pressure of the outside of the wristwatch case 1. As a result, when the head section 16 of the operation member 13 is pulled out toward the outside of the wristwatch case 1, the operation member 13 can slide smoothly and favorably.

In the above-described embodiment, the inner end portion of the small diameter cylindrical section 12*a* of the cylindrical member 12 is held by the inner frame 7 of the timepiece module 6. However, the present invention is not limited thereto. For example, a structure may be adopted in which the inner end portion of the small diameter cylindrical section 12*a* is held by the housing of the timepiece module 6.

Also, in the above-described embodiment, the wristwatch case 1 includes the first case 2 and the second case 3. However, the present invention is not limited thereto. For example, a structure may be adopted in which the wristwatch case 1 is formed by the first case 2 and the second case 3 being integrated.

Moreover, in the above-described embodiment, the elastic contact adjustment section 21 is formed on the tapered surface in which the inner diameter of the head section 16 of the operation member 13 gradually becomes larger from the first position toward the second position. However, the present invention is not limited thereto. For example, a step-like form may be adopted in which the inner diameter of the head section 16 of the operation member 13 in the second position is larger than that in the first position. In addition, a plurality of steps may be respectively formed at a plurality of positions, such as a first position to a third position, so that the inner diameter of the head section 16 of the operation member 13 gradually becomes larger step by step from the first position toward the third position.

Furthermore, in the above-described embodiment and modifications thereof, the present invention has been applied in a wristwatch. However, the present invention is not necessarily required to be applied in a wristwatch, and may be applied in various types of timepieces, such as travel watches, alarm clocks, table clocks, and wall clocks. In addition, the present invention is not necessarily required to be applied in timepieces, and may be applied to various types of electronic devices, such as cellular phones and portable information terminals.

While the present invention has been described with reference to the preferred embodiments, it is intended that the invention be not limited by any of the details of the description therein but includes all the embodiments which fall within the scope of the appended claims.

What is claimed is:

1. A switch device comprising:

a case which is provided with a through hole and has a built-in module;

a cylindrical member which is attached to the through hole of the case, and which includes an inner end portion that protrudes inside the case and is held in the module and an outer end portion that protrudes outside the case; and an operation member including (i) a shaft section which is arranged inside the cylindrical member in a manner to be slidable in an axial direction of the cylindrical member so as to operate the module, and (ii) a head section which is provided on an outer end portion of the shaft section and which covers and slidably holds the outer end portion of the cylindrical member, wherein an inner circumferential surface of the head section of the operation member comprises a tapered surface, wherein the cylindrical member includes a mounting groove which is annularly provided, wherein an elastic retaining member is mounted in an outer circumference portion of the mounting groove, and wherein a notched groove section is formed in the cylindrical member along an axial direction of the cylindrical member and through a position at an inner circumferential side of the elastic retaining member.

2. The switch device according to claim 1, wherein the cylindrical member includes (i) a small diameter cylindrical section which is inserted into and held in the through hole of the case, and which has an inner end portion that protrudes inside the case and is held in the module, and (ii) a large diameter cylindrical section which is provided on an outer end portion of the small diameter cylindrical section and is held by the head section of the operation member.

3. The switch device according to claim 2, further comprising:

a circulation path which communicates between the outside of the case and a space located inside the head section and enclosed by the outer end portion of the cylindrical member and the head section of the operation member.

4. The switch device according to claim 2, wherein the mounting groove is provided in an outer circumference of the large diameter cylindrical section of the cylindrical member, and wherein the elastic retaining member is mounted in the mounting groove in a manner to protrude in a diameter direction of the large diameter cylindrical section, and has a protruding outer circumference portion that comes in elastic contact with the inner circumferential surface of the head section so as to hold the large diameter cylindrical section of the cylindrical member.

5. The switch device according to claim 4, further comprising:

a buffer member which is arranged between an inner end surface inside the head section of the operation member and an outer end surface of the cylindrical member.

6. The switch device according to claim 5, further comprising:

an elastic contact adjustment section which is provided on the inner circumferential surface of the head section of the operation member, and which adjusts the elastic contact between the elastic retaining member and the inner circumferential surface of the head section such that an elastic force of the elastic retaining member when the operation member is located at a second position by being pulled out toward the outside of the case is smaller than an elastic force of the elastic retaining member when the operation member is located at a first position by being pressed toward the inside of the case.

7. The switch device according to claim 6, wherein:

the elastic contact adjustment section is formed on the tapered surface of the inner circumferential surface of the head section of the operation member; and an inner diameter of the head section of the operation member at the tapered surface gradually becomes larger from a position at which the elastic retaining member contacts the inner circumferential surface when the operation member is located at the first position toward another position located closer to the case.

8. The switch device according to claim 4, further comprising:

an elastic contact adjustment section which is provided on the inner circumferential surface of the head section of the operation member, and which adjusts the elastic contact between the elastic retaining member and the inner circumferential surface of the head section such that an elastic force of the elastic retaining member when the operation member is located at a second position by being pulled out toward the outside of the case is smaller than an elastic force of the elastic retaining member when the operation member is located at a first position by being pressed toward the inside of the case.

9. The switch device according to claim 8, wherein:

the elastic contact adjustment section is formed on the tapered surface of the inner circumferential surface of the head section of the operation member; and an inner diameter of the head section of the operation member at the tapered surface gradually becomes larger from a position at which the elastic retaining member contacts the inner circumferential surface when the operation member is located at the first position toward another position located closer to the case.

10. The switch device according to claim 9, wherein the elastic contact adjustment section is configured such that the tapered surface of the inner circumferential surface of the head section of the operation member is inclined within a range of a protrusion length of the elastic retaining member from an outer circumference of the outer end portion of the cylindrical member.

11. The switch device according to claim 2, further comprising:

a buffer member which is arranged between an inner end surface inside the head section of the operation member and an outer end surface of the cylindrical member.

12. The switch device according to claim 11, wherein:

the elastic retaining member comes in elastic contact with the inner circumferential surface of the head section so as to hold the large diameter cylindrical section of the cylindrical member; and the switch device further comprises an elastic contact adjustment section which is provided on the inner circumferential surface of the head section of the operation member, and which adjusts the elastic contact between the elastic retaining member and the inner circumferential surface of the head section such that an elastic force of the elastic retaining member when the operation member is located at a second position by being pulled out toward the outside of the case is smaller than an elastic force of the elastic retaining member when the operation member is located at a first position by being pressed toward the inside of the case.

13. The switch device according to claim 12, wherein:

the elastic contact adjustment section is formed on the tapered surface of the inner circumferential surface of the head section of the operation member; and an inner diameter of the head section of the operation member at the tapered surface gradually becomes larger from a position at which the elastic retaining member contacts the inner circumferential surface when the operation member is located at the first position toward another position located closer to the case.

14. The switch device according to claim 1, further comprising:

a buffer member which is arranged between an inner end surface inside the head section of the operation member and an outer end surface of the cylindrical member.

15. The switch device according to claim 14, wherein:

the elastic retaining member comes in elastic contact with the inner circumferential surface of the head section so as to hold the outer end portion of the cylindrical member; and the switch device further comprises an elastic contact adjustment section which is provided on the inner circumferential surface of the head section of the operation member, and which adjusts the elastic contact between the elastic retaining member and the inner circumferential surface of the head section such that an elastic force of the elastic retaining member when the operation member is located at a second position by being pulled out toward the outside of the case is smaller than an elastic force of the elastic retaining member when the operation member is located at a first position by being pressed toward the inside of the case.

16. The switch device according to claim 15, wherein:

the elastic contact adjustment section is formed on the tapered surface of the inner circumferential surface of the head section of the operation member; and an inner diameter of the head section of the operation member at the tapered surface gradually becomes larger from a position at which the elastic retaining member contacts the inner circumferential surface when the operation member is located at the first position toward another position located closer to the case.

17. The switch device according to claim 16, wherein the elastic contact adjustment section is configured such that the tapered surface of the inner circumferential surface of the head section of the operation member is inclined within a range of a protrusion length of the elastic retaining member from an outer circumference of the outer end portion of the cylindrical member.

18. The switch device according to claim 1, further comprising:

a circulation path which communicates between the outside of the case and a space located inside the head section and enclosed by the outer end portion of the cylindrical member and the head section of the operation member.

19. The switch device according to claim 18, wherein the circulation path includes:

the notched groove section, which is formed in an outer circumference portion of a large diameter cylindrical section of the cylindrical member; and a circulation section which is provided between the inner circumferential surface of the head section and an outer circumferential surface of the large diameter cylindrical section.

20. A timepiece comprising the switch device according to claim 1.

* * * * *